United States Patent [19]

Brown

[11] Patent Number: 4,635,454

[45] Date of Patent: Jan. 13, 1987

[54] LATCH GEAR LOCK ASSEMBLY

[75] Inventor: Alex G. Brown, Greenville, Tenn.

[73] Assignee: Avis Industrial Corporation, Upland, Ind.

[21] Appl. No.: 673,117

[22] Filed: Nov. 19, 1984

[51] Int. Cl.[4] ..... E05B 65/06

[52] U.S. Cl. ..... 70/139; 292/216; 292/210

[58] Field of Search ..... 70/139, 351, 135, 451; 292/210, 216, 227, 229

[56] References Cited

U.S. PATENT DOCUMENTS

| | | | |
|---|---|---|---|
| 2,446,934 | 8/1948 | Krause | 292/332 |
| 2,582,926 | 1/1952 | Dall | 292/216 |
| 2,806,727 | 9/1957 | Johnstone | 292/216 |
| 2,846,253 | 8/1958 | Johnstone | 292/25 |
| 2,865,668 | 12/1958 | Krause | 292/216 |
| 3,332,713 | 7/1967 | De Claire et al. | 292/201 |
| 3,488,984 | 1/1970 | Salonia | 70/451 |
| 3,572,793 | 3/1971 | Cole | 292/216 |
| 3,695,659 | 10/1972 | Gionet et al. | 292/216 |
| 3,697,105 | 10/1972 | Marx | 292/216 |
| 3,730,575 | 5/1973 | Arlauskas et al. | 292/216 |
| 4,194,377 | 3/1980 | Maeda | 292/216 |
| 4,252,369 | 2/1981 | Kluting | 292/210 |

*Primary Examiner*—Robert L. Wolfe

*Attorney, Agent, or Firm*—Albert L. Jeffers; Stephen T. Belsheim

[57] ABSTRACT

A latch gear lock device adapted to releasably secure together relatively movable members has a base and a latch bolt member pivotally mounted on the base. The latch bolt member has a dentate surface, a cam surface and means for receiving a keeper. A latch gear means pivotally mounts on the base for governing movement of the latch bolt member from an unlatched position to a latched position and for providing selected latch positions between the unlatched and latched positions. A biased release means extends through the base and provides for selectively releasing the latch bolt member to its unlatched position.

9 Claims, 9 Drawing Figures

LATCH GEAR LOCK ASSEMBLY

BACKGROUND OF THE INVENTION

This invention pertains to a lock device, and more particularly to a self-contained, self-adjusting latch and lock device to releasably secure together relatively movable members.

There has been an increased demand for an effective, inexpensive latching device capable of securing together relatively movable members such as drawers in a cabinet, automobile doors, automobile hoods, tool box, garage doors and the like. Generally, special lock devices are designed for use on a particular item, i.e., either for an automobile hood, or for a tool box, or for an automobile door. They are not intended to be used in a variety of latching applications. Thus, it would be desirable to provide an improved lock device that is able to be used in a variety of latching applications.

Latching devices which are presently available for automobile doors and hoods as well as for tool boxes usually have many interacting movable parts. Some tool boxes have latching devices which have a cam on the bracket the tool box. As the bracket bar travels down, a hook of the latch member kicks out of the way approximately one-quarter inch. A depressible roll pin of the latch device pushes the cam back ¼" to release the bracket or bar from the latch member. In this type of device, the cam is separate from the locking mechanism, the device latches in only one direction and the device locks in only one position. It would thus be desirable to provide an improved lock device that does not require a great number of moving parts. It would also be desirable to provide an improved lock device that has the ability to latch in either the clockwise or counterclockwise direction.

Other latching mechanisms are available which have a spring biased, pivotal forked bolt member combined with a ratchet tooth portion and which use a spring biased pawl as a detent. Various release means such as levers, cranks or cams are generally combined with such devices to release the pawl from the ratchet teeth in order to open the closure. These devices are also usually limited to only one or very few latch positions, and the bracket or keeper must be in close alignment with the pivotal forked bolt member. It would thus be desirable to provide an improved lock device that provides for a sufficient number of latch positions.

U.S. Pat. No. 2,582,926 to Dall, appears to disclose a latch or lock mechanism for use on automobile doors. This mechanism combines a rotary bolt with a cooperating take-up mechanism for retaining the rotary bolt in a plurality of latching positions provided by a serrated portion on a rotor segment arm. A hook on a take-up arm holds the rotary bolt in the attained latch position. This mechanism has separate inside and an outside release mechanisms as well as a separate lock mechanism. Each of these release mechanisms appear to require substantially exact alignment in order to be effective. It would thus be desirable to provide an improved lock device that operates effectively without the inside and outside release mechanisms being in exact alignment.

SUMMARY OF THE INVENTION

The present invention overcomes many of the problems and disadvantages presently incurred in the industry. The latch gear lock device of the present invention has only three interacting, moveable parts. This device includes a forked latch bolt member, a latch gear means and a release means. The present invention, therefore, provides a self-contained, self-adjusting latching lock device that is able to be used in a variety of latching applications.

The latch gear lock device of the present invention is self-contained, and it requires only a bracket or pin to grasp and move the latch bolt member to any of a plurality of latched positions. A key can be used to turn the key plug to lock the latch bolt member in any latched position. When turned to a locked position, the key plug can not be depressed. Consequently, the latch gear means cannot be disengaged. When the key is turned to the unlocked position, it is possible to depress the key plug and cause it to disengage the latch gear means from the latch bolt member.

This self-adjusting latch gear lock device can receive the bar of a bracket that is not perfectly aligned relative to the device so as to latch together relatively movable members such as a lid and base of a tool box. This latch gear lock device can lock such movable members together in any of a plurality of latch positions.

The simple design of the present invention increases the versatility of this latch gear lock device. This latch gear lock device can be modified to accept a bracket or pin at different points as the latch bolt member moves from a 3 o'clock position to a 12 o'clock position as well as from an 11 o'clock position to a 9 o'clock position and so on. The latching direction can also be changed from counterclockwise to clockwise by simply changing the latch gear mechanism.

In one form of the invention, there is provided a latch gear lock device adapted to releasably secure together relatively movable members comprising a base and a latch bolt member having a pivotal mounting means for permitting selective movement of the latch bolt member between an unlatched position and an extreme latched position. The latch bolt member includes a dentate surface, a cam surface, and a receiving means for receiving a keeper. This latch gear lock device further includes a latch gear means pivotally mounted on the base adjacent the latch bolt member. The latch gear means governs movement of the latch bolt member between the unlatched position and the extreme latched position so that these are provided a plurality of intermediate latch positions between the unlatched position and the extreme latched position. This latch gear lock device also includes a biasing means for biasing the latch bolt member to its unlatched position. The biasing means connects to the latch bolt member and to the latch gear means. The latch gear lock device further includes a release means mounted on the base for selectively releasing the latch bolt member from the latched position and for selectively locking the latch bolt member in any one of the selected latched positions.

In another form of this invention, there is provided a latch gear lock device adapted to releasably secure together relatively movable members. This lock device includes a face plate having an opening therethrough, and an integral plastic base connected to one surface of the face plate. A plastic latch bolt member is pivotally mounted on the base. The latch bolt member is selectively movable to any of a plurality of latch positions between an unlatched position and a latched position. The latch bolt member includes a cam surface, a dentate surface, and means for receiving a keeper.

This latch gear lock device further includes a plastic latch gear means mounted on the base adjacent the latch bolt member. The latch gear means governs movement of the latch bolt member to any of a plurality of latched positions between the unlatched position and the latched position. This latch gear means includes a dentate surface, a pawl portion including a dogging lever with a pawl tooth adapted to oppose the dentate surface, and an axial pins for pivotal movement.

This latch gear lock device further includes biasing means connected to the latch bolt member and to the latch gear means for biasing the latch bolt member to its unlatched position. This latch gear lock device further includes a rod means received by the opening in the face plate. This rod means extends through the base and has an inner end adjacent the lock gear means. The rod means is biased outwardly and can be depressed to pivot the pawl tooth of the lock gear means away from the dentate surface of the latch bolt member to release the latch bolt member to the unlatched position.

In accordance with another form of the present invention, there is provided a latch gear lock device adapted to releasably secure together relatively movable members. This latch gear lock device comprises a face plate having a transverse opening therethrough and a base extending from one surface of the face plate. The base includes a flange means forming a channel around the base between the face plate and the flange. This latch gear lock device includes a removable mounting means for holding the latch gear lock device in position on one of the relatively movable members. The removable mounting means has arcuate spaced-apart arms to be held within the channel.

This latch gear lock device further includes a latch bolt member pivotally mounted on the base about an axis permitting rotation between an unlatched position and a latched position. The latch bolt member has a cam surface, a keeper receiver portion having a keeper receiving surface, and a latch bolt dentate surface opposite the keeper receiving portion. The latch bolt dentate surface is substantially concentric with the axis of rotation.

This latch gear lock device further includes a latch gear means for permitting selection of any of a plurality of latched positions between the unlatched position and the latched position. The latch gear means pivotally mounts on the base for governing movement of the latch bolt member between the unlatched position and the latched position and maintains the latch bolt member in its latched position between the unlatched position and the latched position. The latch gear means includes a latch gear dentate surface and a pawl portion having a dogging lever with a pawl tooth means for opposing the dentate surface of the latch bolt member. This latch gear lock device further includes biasing means connected to the latch bolt member and to the latch gear means for biasing the latch bolt member to its unlatched position. The latch gear lock device further includes a depressible rod means biased outwardly for releasing the latch bolt member from the pawl tooth restraint. The rod means includes a lock mechanism for selectively locking the latch member in any of its latched positions.

In accordance with the present invention, there is a provided a latch gear lock device that can be used in a variety of latching applications such as for a garage door, a truck tool box, and the like. When mounted, this latch gear lock device requires only a bracket or keeper on the other relatively movable member that can grasp and move the latch bolt member down to a latch position. The latch bolt member can be locked in its latched position by turning the key to rotate the key plug to a locked position which prevents depression of the key plug. When the key is turned to the unlocked position, the item such as the tool box can be opened by depressing the key plug to contact and cause the latch gear means to pivot out of contact with the latch bolt member. As the latch gear means releases the latch bolt member, the biasing means causes the latch bolt member to snap to its unlatched position. When the latch bolt member reaches the unlatched position, it releases the bracket on the tool box.

It is an object of this invention to provide a latch gear lock device for releasably securing together relatively movable members.

It is another object of this invention to provide an efficient and economical latch gear lock device.

It is another object of this invention to provide a self-contained latch gear lock device.

It is yet another object of this invention to provide a self-adjusting latch gear lock device.

It is a further object of this invention to provide a latch gear lock device which is versatile in its application.

The above-mentioned and other features and objects of this invention, and the manner of attaining them will become more apparent, and the invention itself will be best understood by reference to the following description of embodiments of the invention taken in conjunction with the accompanying drawings.

BRIEF DESCRIPTION OF THE DRAWINGS

FIG. 1(*b*)is a perspective view of the latch gear lock device mounted on the truck tool box wherein the latch gear lock device is attached to the open tool box;

FIG. 6(*b*is a mechanical schematic side view of the device in a latched position; and FIG. 6(*c*) is a mechanical schematic side view of the device with depressed key plug releasing latched bolt member from a latched position.

DETAILED DESCRIPTION OF A SPECIFIC EMBODIMENT

Figure 1A:
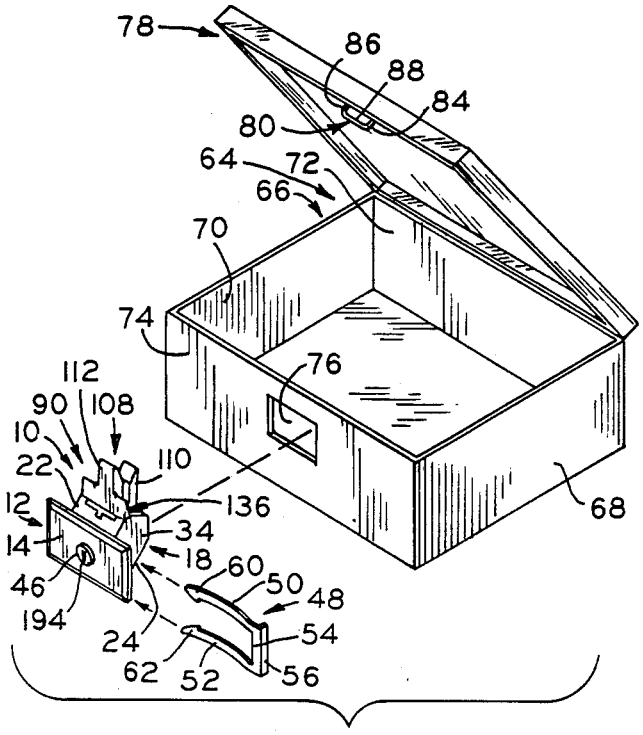
FIG. 1 (*a*) is a perspective view of the latch gear lock device and a truck tool box wherein the latch gear lock device is exploded away from the open tool box.

Referring now to FIGS. 1–5 of the drawings, there is shown the latch gear lock device of the invention, generally indicated at 10. Latch gear lock device 10 has face plate generally designated as 12. Face plate 12 has front surface 14 and rear surface 16.

Latch gear lock device 10 further includes an integral base member generally designated as 18 that extends rearwardly and substantially upwardly from rear surface 16 of the face plate. Base member 18 has a forward portion 20 at the connection with face plate rear surface 16, and a rear portion 30. Base member 18 further includes a top surface 22 and a bottom surface 24. A radially extending flange 26 is positioned in a spaced-apart fashion near forward portion 20 so as to define a groove 28 between base forward portion 20 and flange 26. A pair of integral upstanding walls 34, 36 extend rearwardly and substantially upwardly from bottom surface 24, and extend rearwardly and substantially downwardly from top surface 22 to terminal portions 38, 40 respectively. Rear portion 30 contains a generally vertically disposed channel 32 therein being open at the top end thereof.

Figure 3:
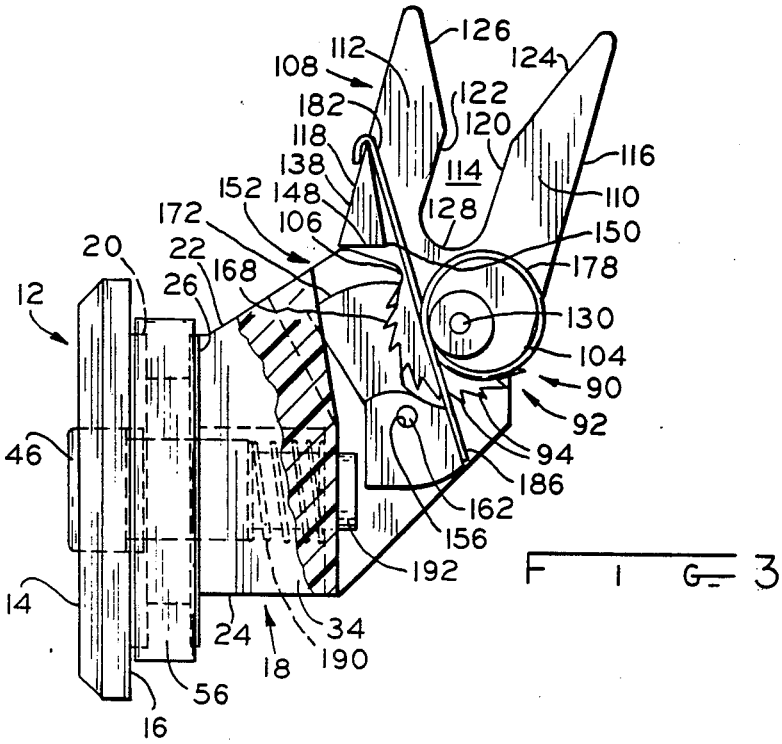
FIG. 3 is side view of the latch gear lock device.

Face plate member 12 has an opening 42 passing therethrough. Rear portion 30 of the base member has opening 44 passing therethrough. See FIG. 2. Openings 42 and 44 are both in general axial alignment with the longitudinal axis of latch gear lock 10. Openings 42 and 44 communicate within base member 18 as illustrated in FIG. 3. Openings 42 and 44 together receive key plug member 46 therein.

Latch gear lock mechanism also includes removable mounting clip 48 with arcuate arms 50, 52 connected at one end by an integral cross bar 54. Cross bar 54 has upward projecting flange 56 extending along its edge 58 opposite arcuate arms 50, 52 and upwardly from convex surface of arcuate arms 50, 52. See FIGS. 1(*a*), 4 and 5. Flange 56 provides means for grasping removable mounting clip 48. Each of arcuate arms 50, 52 have centrally offset terminal end portions 60, 62, respectively, for holding removable mounting clip 48 within groove 28. See FIGS. 1(*a*) and 2.

Figure 1B:
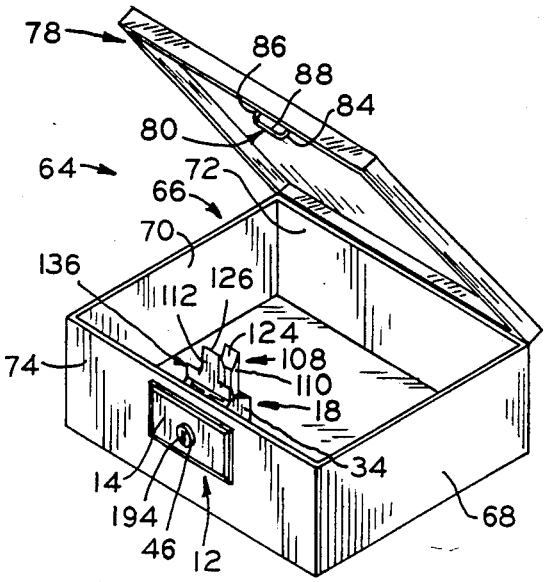
Figure 2:
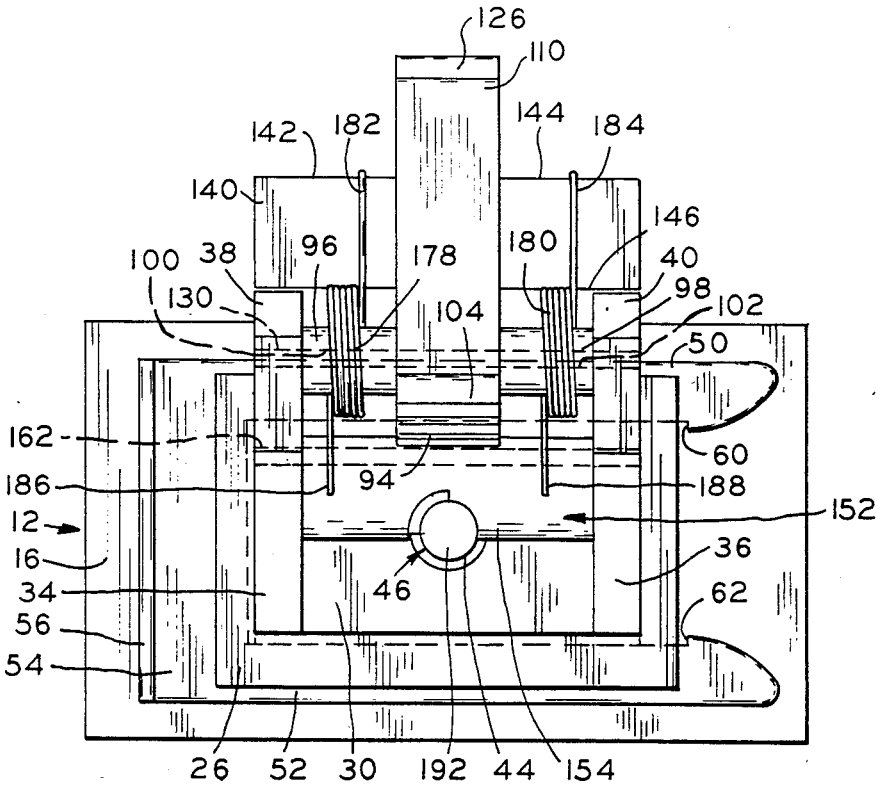
FIG. 2 is a rear view of the latch gear lock device.

Referring now to FIGS. 1(*a*) and 1(*b*), tool box 64 has container portion 66 defined by spaced-apart end walls 68, 70 spaced-apart rear and front walls 72 and 74 respectively, and a bottom wall. Front wall 74 has transverse opening 76 therethrough for receiving base member 18. Tool box 64 has lid 78 with bracket member 80 extending from a front portion of lid 78. Bracket member 80 has substantially parallel arms 84, 86 connected at one end to front portion and at an opposite end by bracket bar 88.

Front wall opening 76 receives base member 18 therein. Face plate 12 covers and extends beyond the outer perimeter of front wall opening 76. Removable mounting clip 48 fits in groove 28. Arcuate arms 50, 52, provide tension within groove 28 to maintain latch gear lock device 10 within front wall opening 76. Arm terminal end portions 60, 62, hold arcuate arms 50, 52, respectively, in position within groove 28.

Figure 6A:
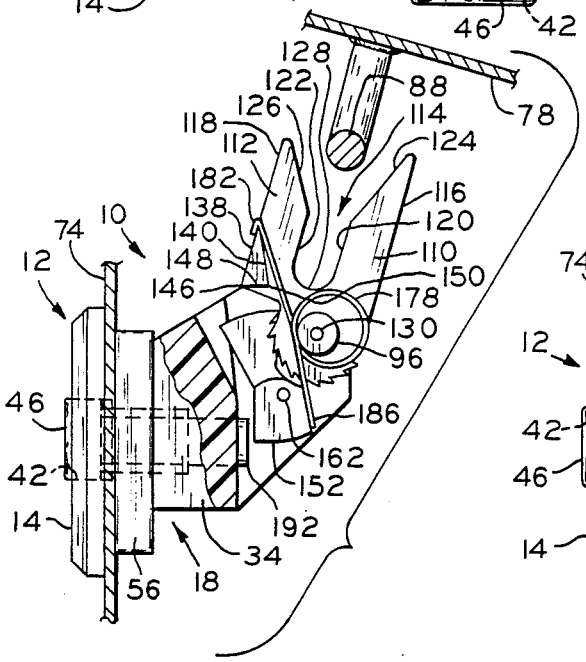
FIG. 6(*a*) is a mechanical schematic side view of the device in the open position.
Figure 6B:
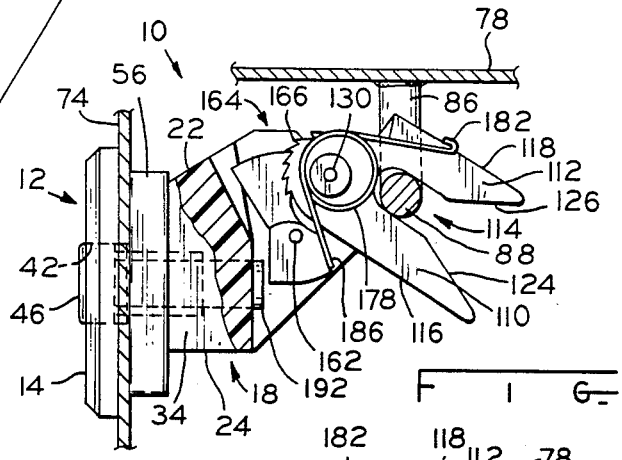
Figure 6C:
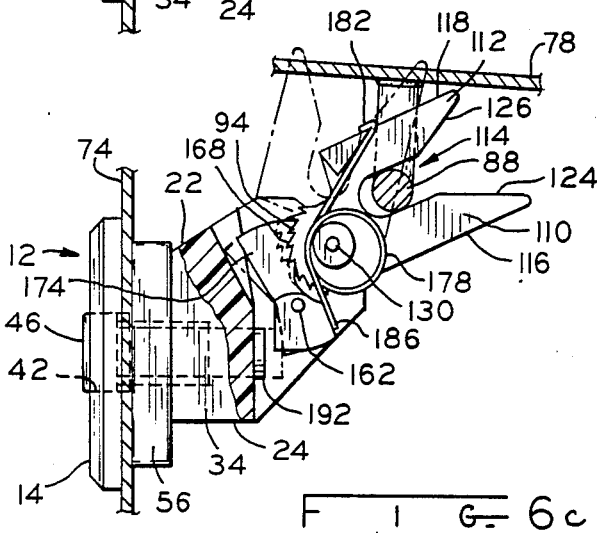

Referring now to FIGS. 3, and 6(*a*),(*b*) (*c*), latch gear lock device 10 further comprises latch bolt member 90 having an integral curved end portion 92 with dentate surface 94. Latch bolt member 90 further includes lateral arms 96, 98 having openings 100, 102, respectively. Openings 100, 102 communicate within arms 96, 98 at approximately the center of curved end portion 92. Latch bolt member 90 further includes cam surface 104, ramp surface 106 and integral keeper receiving portion 108. Keeper receiving portion 108 extends opposite curved end portion 92.

Keeper receiving portion 108 includes integral spaced-apart arms 110, 112 and recess 114. Spaced-apart arms 110, 112 have outer surfaces 116, 118, respectively, shorter inner surfaces 120, 122, respectively, and terminal surfaces 124, 126, respectively. Terminal surfaces 124, 126 incline downwardly from outer surfaces 116, 118, respectively, to inner surfaces, 120, 122 respectively. Terminal surfaces 124, 126 provide ramp-like surfaces to guide bracket bar 88 (keeper) into keeper recess 114. Keeper recess 114 terminates in a curved surface 128.

Latch bolt member 90 pivotally mounts on base member 18 by pin 130. Lateral walls 38, 40 have aligned openings 132, 134, respectively. Each of openings 132, 134, also align with lateral arm openings, 100, 102, respectively. Openings 100, 102, 132 and 134 receive pin 130. Pin 130, therefore, provides the pivotal point for rotation of latch bolt member 90 between unlatched and latched positions.

Figure 4:
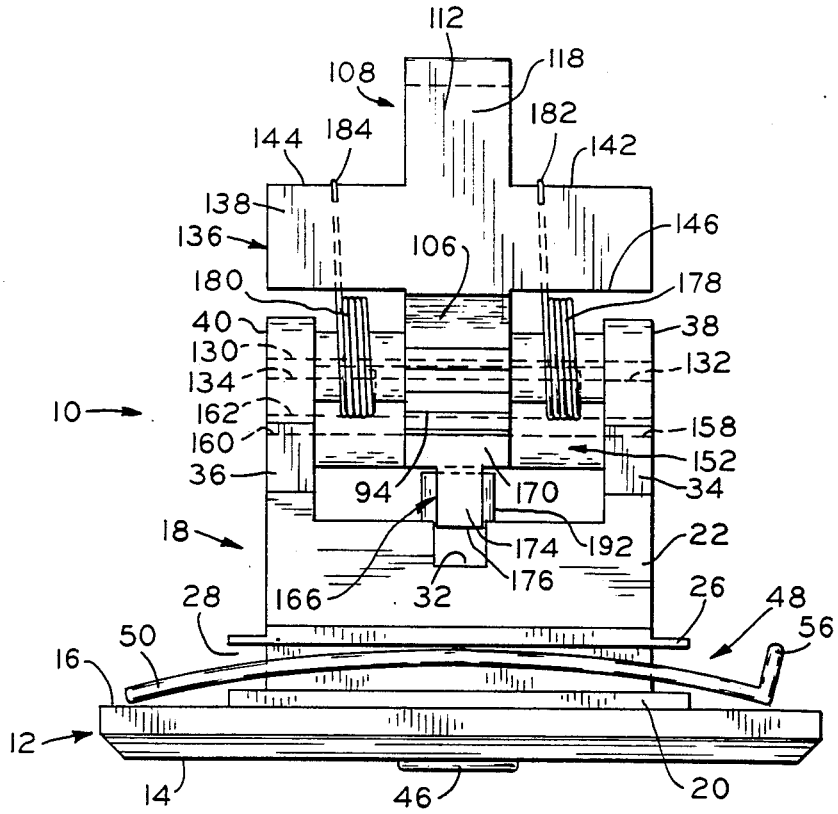
FIG. 4 is a top plan view of the latch gear lock device in a closed position.
Figure 5:
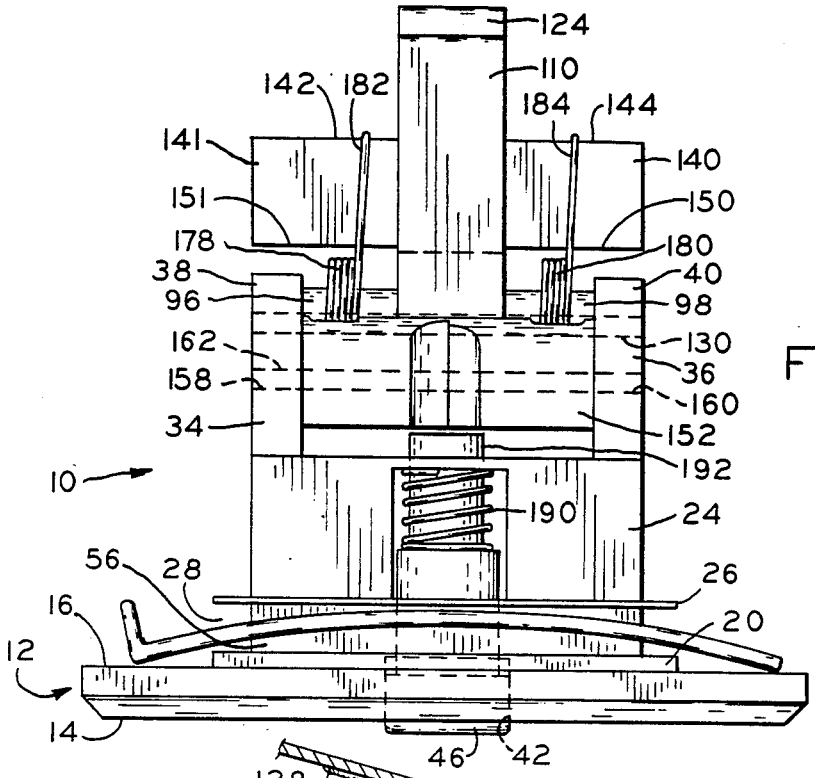
FIG. 5 is a bottom plan view of the latch gear lock device in the closed position.

Latch bolt member 90 further comprises cross bar member 136 see FIG. 4. Cross bar member 136 extends across a lower end portion of outer surface 118 from opposite sides of keeper arm 112 and over lateral walls 34, 36 respectively. Cross bar 136 has top surface 138 continuous with outer surface 118, and shorter bottom surfaces 140, 141 on opposite sides of keeper arm 112. Top surface 138 and bottom surfaces 140, 141 abut along rearward edges 142, 144, respectively. Top surface 138 has forward edge 146 continuous with forward edge portion of keeper receiving arm 112. Cross bar member 136 further includes forward surface 148. Bottom surfaces 140, 141 include forward edges 150, 151. Forward surface 148 connects forward edge 146 to forward edge 150, 151, respectively. As latch bolt member 90 rotates in a counterclockwise direction, opposite end portions of forward surface 148 contact lateral walls 34, 36 and prevent further counterclockwise rotation.

Latch gear lock device 10 further comprises latch gear mechanism 152 having integral cross member 154 with transverse opening 156 therethrough. Opposite ends of opening 156 align with openings 158, 160 extending transversely through lateral walls 34, 36. Openings 156, 158, 160 receive pin 162 therethrough for pivotally mounting latch gear mechanism 152 on base portion 18.

Referring now to FIG. 3, latch gear mechanism 152 has pawl member 164 (FIG. 3) extending substantially upwardly from a central portion of cross member 154. Pawl member 164 includes a curved dogging lever portion 166 having a dentate inner surface 168 and a pawl tooth 170 at its terminal end opposite cross member 154. Outer curved surface 172 of dogging lever 166 has projection 174 extending slightly forwardly and upwardly from the approximate midpoint of outer curve surface 172 and terminating in top surface 176. Top surface 176 extends substantially centrally and above pawl tooth 170.

Dentate inner surface 168 cooperates with dentate surface 94. Dentate inner surface 168 provides a gear means both for governing counterclockwise movement of latch bolt member 90 and for providing a plurality of latch positions between an unlatched position and a latched position of latch bolt member 90. Pawl tooth 170 restrains rotation of latch bolt member 90 to one direction.

When latch gear means 152 pivots in a counterclockwise direction, pawl tooth 170 and dentate inner surface 168 pivot away from contact with dentate surface 94. When so released from pawl tooth 170, latch bolt member 90 can rotate in a counterclockwise direction to return to its open position. As latch gear means 152 rotates in a counterclockwise direction, channel 32 received projection 174. The depth of channel 32 limits the counterclockwise pivotal movement of latch gear means 152.

Latch gear lock device 10 further includes springs 178, 180 mounted on lateral latch bolt arms 96, 98, respectively, between keeper receiving portion 108 and lateral walls 34, 36, respectively. Springs 178, 180 include arms 182, 184, respectively, and arms 186, 188, respectively. Arms 182, 184 connect to cross bar 136 on either side of keeper receiving arm 112. Arms 186, 188 connect to latch gear cross member 154 on either side of pawl member 164. Springs 178, 180 bias latch bolt member 90 to snap to its unlatched position when latch gear means 152 pivots in a counterclockwise direction and releases pawl tooth 170 from its contact with dentate surface 94.

Key plug member 46 has spring 190 which biases key plug member 46 outwardly. Key plug member 46 is any commercially available depressible key plug having a key slot and a device for blocking key plug member 46 in a locked position. When key plug member 46 is depressed against biasing force of spring 190, rearward end 192 contacts cross member 154 and causes latch gear means 152 pivot in a counterclockwise direction. As latch gear mechanism 152 pivots, it releases pawl tooth 170 from dentate surface 94, and springs 178, 180 urge latch bolt member 90 to snap to its unlatched position. Key plug member 46 has key hole 194 to accommodate a key (not shown) for selectively locking and unlocking key plug member 46.

Referring now to FIGS. 6(*a*),(*b*),(*c*), latch gear lock device 10 is shown in its unlatched, and latched positions and as it is being released from its latched position. In both the unlatched position and the latched position shown in FIGS. 6(*a*) and 6(*b*), dentate inner surface 168 cooperatively contacts dentate surface 94, and pawl tooth 170 restrains latch bolt member 90 from counterclockwise rotation. In these positions, spring 190 biases key plug 46 outwardly and prevents key plug 46 from contacting latch gear cross member 154. Depression of key plug 46 causes latch gear means 152 to pivot in a counterclockwise direction and to release pawl tooth 170 from dentate surface 94.

When dentate surface 94 contacts dentate inner surface 168, latch bolt member 90 can be locked in any of the plurality of latch positions defined by curved dentate inner surface 168. A key (not shown) can lock key plug member 46 to hold latch bolt member 90 in any of those latch positions.

While the present invention is formed by injection molded plastic, it is to be understood that any suitable material can be used which will provide a strong, corrosion-resistant latching and locking device capable of securing together relatively movable members.

While there have been described above the principles of this invention in connection with a specific device, it is to be clearly understood that this description is made only by way of example and not as a limitation to the scope of the invention.

What is claimed is:

1. A latch gear lock device adapted to releasably secure together relatively movable members wherein one of said movable members mounts a keeper, said latch gear lock device comprising:

a base mountable to the other of said movable members;

a latch bolt member having a pivotal mounting means pivotally mounted to said base so as to be selectively movable between an unlatched position and an extreme latched position, and including a pair of spaced apart arms defining therebetween a keeper recess, each of said arms having at its distal end a terminal inner surface inclining towards said keeper recess, said latch bolt member being mounted to said base so that upon movement of the movable members towards one another, the keeper can contact said latch bolt member anywhere alont either one inner surface of said respective arms thereof causing said latch bolt member to pivot correspondingly in either clockwise or counterclockwise direction so as to align the keeper with said keeper recess so that upon further movement of the movable members toward each other the keeper is received in said keeper recess, said latch bolt member including a detate surface and a cam surface;

a latch gear means, pivotally mounted on said base and adjacent said latch bolt member, for governing said latch bolt member movement between the unlatched and extreme latched positions so that they are provided a plurality of intermediate latched positions between the unlatched and extreme latched positions;

a biasing means, connected to said latch bolt member and to said latch gear means, for biasing said latch bolt member to its unlatched position; and a release means, mounted on said base, for selectively releasing said latch bolt member from any one of the selected latched positions and selectively locking said latch bolt member in any one of the selected latched positions.

2. The latch gear lock device of claim 1 wherein said latch bolt member has opposite ends, said dentate surface being at one of said ends of said latch bolt member, said dentate surface is substantially concentric with respect to said pivotal mounting means, said spaced apart arms of said latch bolt member are at the other end of said latch bolt member, and said cam surface extends between said dentate surface and said arms.

3. The lock device of claim 1, wherein said latch gear means includes: a latch gear dentate surface, said latch gear dentate surface is adapted to cooperate with said latch bolt detente surface so as to provide the plurality of latched positions of the latch bolt member.

4. The lock device of claim 3, wherein said biasing means further acts upon said latch bolt to urge said latch gear detente surface toward engagement with said latch bolt dentate surface, said latch gear means engaging said latch bolt member at each of the latched positions.

5. The lock device of claim 4, wherein said release means includes a depressibly mounted plug biased away from said latch gear means, said plug having an inner end positioned adjacent said lock gear means so that upon said plug being depressed past a selected position said inner end engages said lock gear means to pivot it away from said latch bolt member so as to cause said dentate surfaces to become disengaged whereby said latch bolt member is biased to its unlatched position.

6. A latch gear lock device adapted to releasably secure together relatively movable members wherein one of said movable members mounts a keeper, said latch gear lock device comprising:

a face plate having an opening therethrough, said plate being mountable to the other of said movable members;

an integral plastic base connected to one surface of said face plate;

a plastic latch bolt member pivotally mounted to said base and selectively movable to certain selected positions between and to an unlatched position and an extreme latched position, said latch bolt member including a pair of spaced apart arms defining therebetween a keeper recess, each of said arms having at its distal end a termainal inner surface inclining towards said keeper recess, said pivotal mounting of said latch bolt member to said base being such that upon movement of the movable members towards one another the keeper can contact said latch bolt member anywhere along either one inner surface of said respective arms thereof causing said latch bolt member to pivot correspondingly in either clockwise or counterclockwise direction so as to align the keeper with said keeper recess so that upon further movement of the movable members toward each other the keeper is received in said keeper recess, said latch bolt member including a cam surface and a dentate surface;

a plastic latch gear means, mounted on said base and adjacent said latch bolt member, for governing movement of said latch bolt member to any of a plurality of latched positions between the unlatched position and said latched positon, said latch gear means including:

a dentate surface, a pawl portion including a dogging lever with a pawl tooth adapted to oppose said dentate surface of said latch bolt member, and an axial means for pivotal movement;

biasing means, connected to said latch bolt member and to said latch gear means, for biasing said latch bolt member to its unlatched position; and a depressible rod means received in said base and biased outwardly, for pivoting said pawl tooth away from said dentate surface of said latch bolt member to release said latch bolt member to said unlatched position.

7. The lock device of claim 6, wherein said lock device includes a removable mounting means for removably mounting the lock device on one of said relatively movable members.

8. The locking device of claim 7, wherein said removable mounting means includes:

a flange defining a channel between said one surface of said face plate and said base; and a molded plastic clip having one closed end portion and spaced-apart arcuate arms having centrally offset terminal end portions for holding said clip within said channel.

9. A latch gear lock device adapted to releasably secure together relatively movable members wherein one of said movable members mounts a keeper, said latch gear lock device comprising:

a face plate having a transverse opening therethrough;

a base on one surface of said face plate, said base including a flange means forming a channel around said base between said face plate and said flange;

a removable mounting means for holding said latch gear lock device in position on one of the relatively movable members, said removable mounting means having arcuate spaced-apart arms to be held within said channel;

a latch bolt member pivotally mounted on said base about an axis permitting rotation between an unlatched position and a latched position, said latch bolt member including a cam surface and a keeper receiving portion including a pair of spaced apart arms defining therebetween a keeper recess, each of said arms having at its distal end a terminal inner surface inclining towards said keeper recess, said pivotal mounting of said latch bolt member to said base being such that upon movement of the movable members towards one another, the keeper can contact said latch bolt member anywhere along either one inner surface of said respective arms thereof causing said latch bolt member to pivot correspondingly in either clockwise or counterclockwise direction so as to align the keeper with said keeper recess so that upon further movement of the movable members toward each other the keeper is received in said keeper recess, said latch bolt member further including a latch bolt dentate surface opposite said keeper receiving portion, and said latch bolt dentate surface being substantially concentric with said axis of rotation;

a latch gear means for providing a plurality of latch positons between said unlatched position and said latched position, said latch gear means pivotally mounted on said base for governing movement of said latch bolt member between said unlatched position and said latched position and for maintaining said latch bolt member in any of said plaurlity of positions between said unlatched positon and said latched position, said latch gear including a latch gear dentate surface and a pawl portion having a dogging lever with a pawl tooth means for opposing said latch bolt dentate surface;

a biasing means, connected to said latch bolt member and to said latch gear means, for biasing said latch bolt member to its unlatched position; and a depressible rod means, received in said base and biased outwardly, for releasing said latch bolt member from said pawl tooth restraint, said rod means includes a lock mechanism for selectively locking said latch bolt member in any of the selected latched positions.

* * * * *